US010593280B2

(12) United States Patent
Zhao

(10) Patent No.: US 10,593,280 B2
(45) Date of Patent: Mar. 17, 2020

(54) SCANNING DRIVING CIRCUIT AND DISPLAY DEVICE

(71) Applicant: Wuhan China Star Optoelectronics Technology Co., Ltd., Wuhan (CN)

(72) Inventor: Mang Zhao, Shenzhen (CN)

(73) Assignee: WUHAN CHINA STAR OPTOELECTRONICS TECHNOLOGY CO., LTD., Wuhan (CN)

( * ) Notice: Subject to any disclaimer, the term of this patent is extended or adjusted under 35 U.S.C. 154(b) by 0 days.

(21) Appl. No.: 15/740,458

(22) PCT Filed: Oct. 21, 2017

(86) PCT No.: PCT/CN2017/107174

§ 371 (c)(1),
(2) Date: Aug. 27, 2018

(87) PCT Pub. No.: WO2019/061603

PCT Pub. Date: Apr. 4, 2019

(65) Prior Publication Data

US 2019/0096349 A1 Mar. 28, 2019

(30) Foreign Application Priority Data

Sep. 27, 2017 (CN) ..... 2017 1 0932078

(51) Int. Cl.
*G09G 3/36* (2006.01)

(52) U.S. Cl.
CPC ... *G09G 3/3677* (2013.01); *G09G 2300/0408* (2013.01); *G09G 2310/0283* (2013.01); *G09G 2310/0286* (2013.01); *G09G 2310/061* (2013.01)

(58) Field of Classification Search
CPC ..... G09G 3/3677; G09G 2310/0286; G09G 2300/0408; G09G 2310/061; G09G 2310/0283
See application file for complete search history.

(56) References Cited

U.S. PATENT DOCUMENTS

| | | | | |
|---|---|---|---|---|
| 2015/0091887 | A1* | 4/2015 | Ochiai | G11C 19/28 345/212 |
| 2016/0307533 | A1* | 10/2016 | Cao | G09G 3/3677 |
| 2017/0193946 | A1* | 7/2017 | Huang | G09G 3/3677 |
| 2018/0040382 | A1* | 2/2018 | Gu | G09G 3/3674 |
| 2018/0151148 | A1* | 5/2018 | Wu | G09G 5/003 |

* cited by examiner

*Primary Examiner* — Carolyn R Edwards
(74) *Attorney, Agent, or Firm* — Brinks Gilson & Lione

(57) ABSTRACT

The present disclosure provides a scanning driving circuit and a display device. The scanning driving circuit includes a plurality of stages of scanning driving units in cascade connection. The plurality of stages of scanning driving units include a first stage scanning driving unit, a plurality of intermediate stage scanning driving units and a last stage scanning driving unit each including a forward and reverse scanning circuit configured to control the scanning driving circuit to forward scanning or reverse scanning, an input circuit configured to charge a pull-up control signal point, a latch circuit configured to latch a signal of the pull-up control signal point, an output circuit configured to generate a scanning driving signal, and a reset circuit configured to reset the pull-up control signal point, which reduces the number of signal lines, simplifies the signal line design, saves space and facilitates the narrow frame design.

15 Claims, 5 Drawing Sheets

SCANNING DRIVING CIRCUIT AND DISPLAY DEVICE

CROSS-REFERENCE TO RELATED APPLICATIONS

The present application is a 35 U.S.C. § 371 National Phase conversion of International (PCT) Patent Application No. PCT/CN2017/107174 filed Oct. 21, 2017, which claims foreign priority to Chinese Patent Application No. 201710932078.0, filed on Sep. 27, 2017 in the State Intellectual Property Office of China, the entire contents of which are hereby incorporated by reference.

TECHNICAL FIELD

The present disclosure relates to the field of display technology, and in particular to a scanning driving circuit and a display device.

BACKGROUND

GOA (Gate Driver On Array) is a technology that adapts the thin film transistor liquid crystal display array process to fabricate the gate line scanning driving signal circuits on the array substrate to realize the driving method of the progressive display of the display device. With the development of low temperature poly silicon (LTPS) semiconductor thin film transistors, and due to the LTPS semiconductor itself with the characteristics of ultra-high carrier mobility, the corresponding peripheral integrated circuits of display devices have become the focus of the art. However, when the scanning driving circuit of the conventional display device performs a forward scanning or a reverse scanning, both the first-stage scanning driving unit and the last-stage scanning driving unit need to receive trigger signals STV, which increases the number of signal lines, makes the signal line design complicated, takes up more space, and is not suitable for narrow frame design.

SUMMARY

The main technology issue to be solved in the disclosure is to provide a scanning driving circuit and a display device which simplifies the signal line design, saves the space and facilitates to the narrow frame design.

In order to solve the above-mentioned main technology issue, one approach of the present disclosure is to provide a scanning driving circuit which comprises a plurality of stages of scanning driving units in cascade connection. The plurality of stages of scanning driving units comprise a first stage scanning driving unit, a plurality of intermediate stage scanning driving units, and a last stage scanning driving unit. Each of the first stage scanning driving unit, each the intermediate stage scanning driving units, and the last scanning driving unit comprises:

a forward and reverse scanning circuit, configured to control the scanning driving circuit to forward scanning or reverse scanning, wherein the forward and reverse scanning circuit of the first stage scanning driving unit receives a forward scanning control voltage, a reverse scanning control voltage, and an output voltage of a turn-on voltage terminal, the forward and reverse scanning circuit of each of the intermediate stage scanning driving units receives the forward scanning control voltage and the reverse scanning control voltage, and the forward and reverse scanning circuit of the last stage scanning driving unit receives the forward scanning control voltage, the reverse scanning control voltage, the output voltage of the turn-on voltage terminal, and the output voltage of a turn-off voltage terminal;

an input circuit, connected to the forward and reverse scanning circuit and configured to receive a first clock signal and a second clock signal opposite to the first clock signal in phase and charge a pull-up control signal point;

a latch circuit, connected to the input circuit and configured to receive the first clock signal and the second clock signal and latch signal of the pull-up control signal point;

an output circuit, connected to the latch circuit and configured to receive a third clock signal and generate a scanning driving signal in response to the third clock signal and the signal of the pull-up control signal point; and a reset circuit, connected to the latch circuit and configured to receive reset signals and reset the pull-up control signal point.

In order to solve the above-mentioned main technology issue, another approach of the present disclosure is to provide a display device which comprises a scanning driving circuit. The scanning driving circuit comprises a plurality of stages of scanning driving units in cascade connection. The plurality of stages of scanning driving units comprise a first stage scanning driving unit, a plurality of intermediate stage scanning driving units, and a last stage scanning driving unit. Each of the first stage scanning driving unit, each the intermediate stage scanning driving units, and the last scanning driving unit comprises:

a forward and reverse scanning circuit, configured to control the scanning driving circuit to forward scanning or reverse scanning, wherein the forward and reverse scanning circuit of the first stage scanning driving unit receives a forward scanning control voltage, a reverse scanning control voltage, and an output voltage of a turn-on voltage terminal, the forward and reverse scanning circuit of each of the intermediate stage scanning driving units receives the forward scanning control voltage and the reverse scanning control voltage, and the forward and reverse scanning circuit of the last stage scanning driving unit receives the forward scanning control voltage, the reverse scanning control voltage, the output voltage of the turn-on voltage terminal, and the output voltage of a turn-off voltage terminal;

an input circuit, connected to the forward and reverse scanning circuit and configured to receive a first clock signal and a second clock signal opposite to the first clock signal in phase and charge a pull-up control signal point;

a latch circuit, connected to the input circuit and configured to receive the first clock signal and the second clock signal and latch signal of the pull-up control signal point;

an output circuit, connected to the latch circuit and configured to receive a third clock signal and generate a scanning driving signal in response to the third clock signal and the signal of the pull-up control signal point; and a reset circuit, connected to the latch circuit and configured to receive reset signals and reset the pull-up control signal point.

The present disclosure has the following advantages: different from the prior art, the scanning driving circuit and the display device of the present disclosure differentiate the forward and reverse scanning circuits of the first stage scanning driving unit and the last stage scanning driving unit from the forward and reverse scanning driving circuits of the other intermediate stage scanning driving units, wherein the forward and reverse scanning circuit of the first stage scanning driving unit receives the forward scanning control voltage, the reverse scanning control voltage, and the output voltage of the turn-on voltage terminal; the forward and reverse scanning circuit of each of the intermediate stage scanning driving units receives the forward scanning control voltage and the reverse scanning control voltage; and the forward and reverse scanning circuit of the last stage scanning driving unit receives the forward scanning control voltage, the reverse scanning control voltage, the output voltage of the turn-on voltage terminal, and the output voltage of the turn-off voltage terminal. Thus, when the scanning driving circuit performs forward scanning or reverse scanning there is no needs to receive trigger signals, which reduces the number of signal lines, simplifies the signal line design, saves the space and facilitates to the narrow frame design.

DETAILED DESCRIPTION

Figure 1:
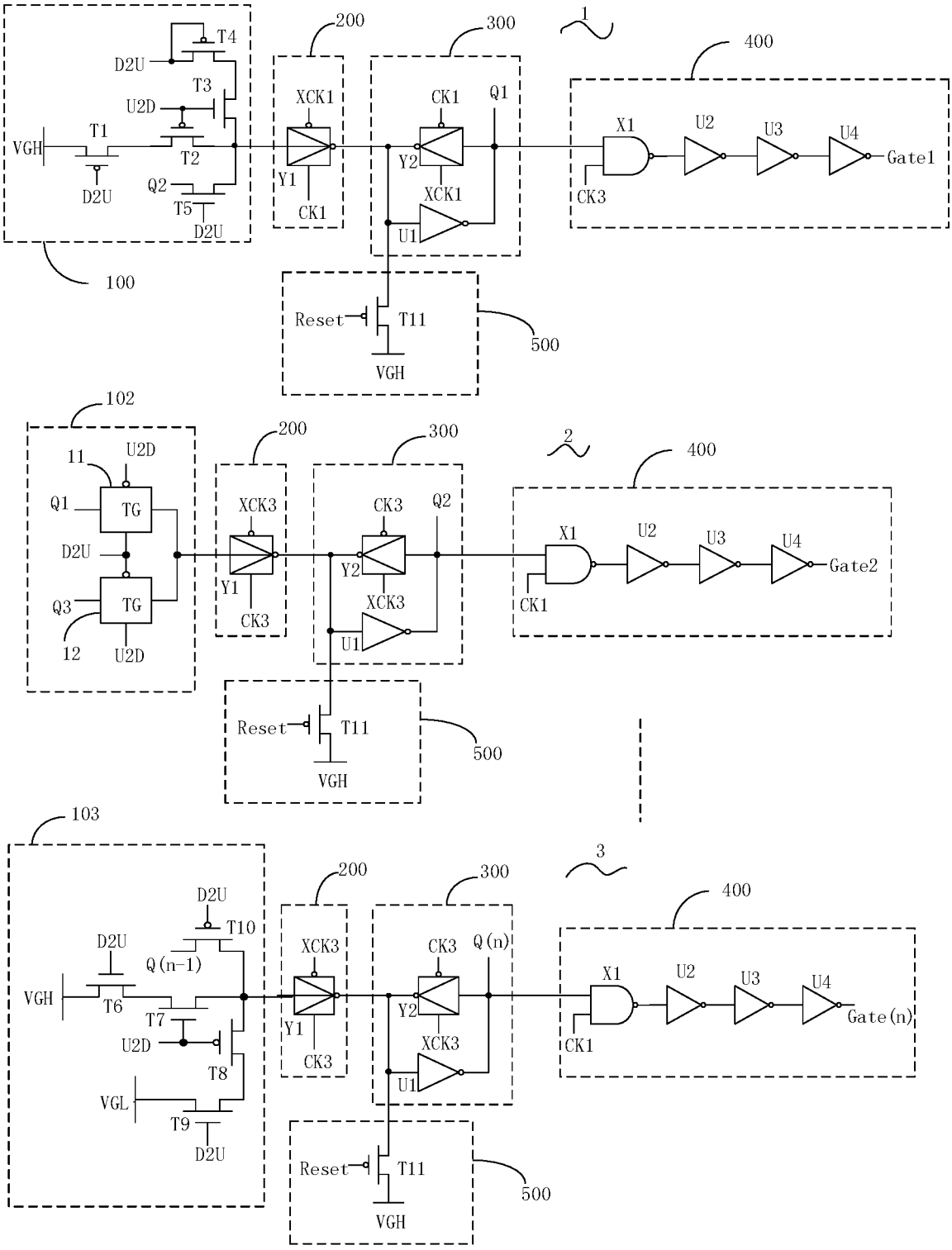
FIG. 1 is a schematic circuit of a first embodiment of the scanning driving circuit of the present disclosure.
Figure 2:
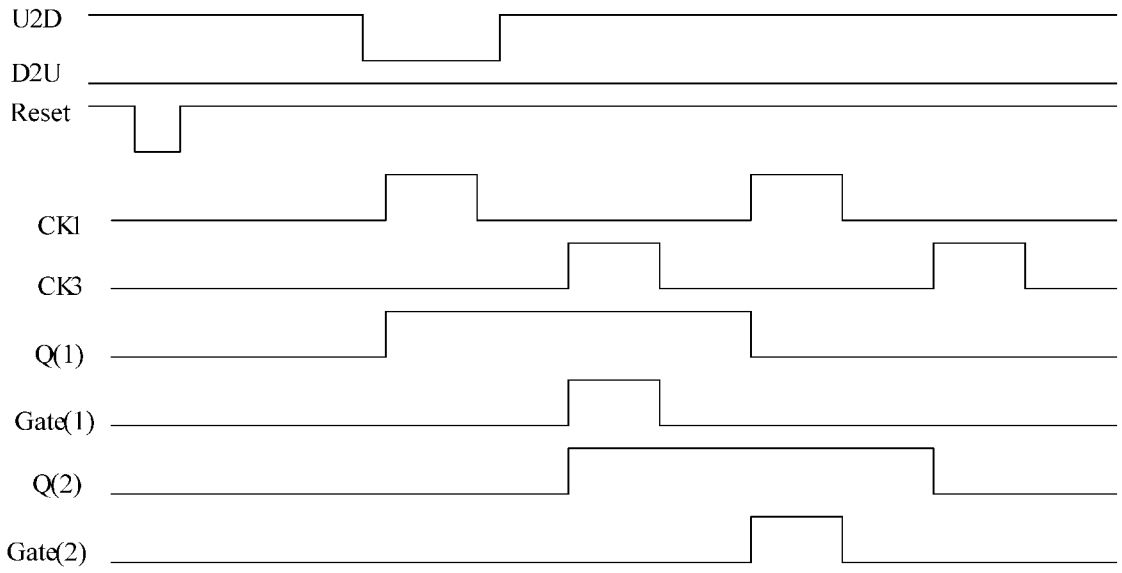
FIG. 2 is a timing diagram of the scanning driving circuit of the present disclosure performing forward scanning.
Figure 3:
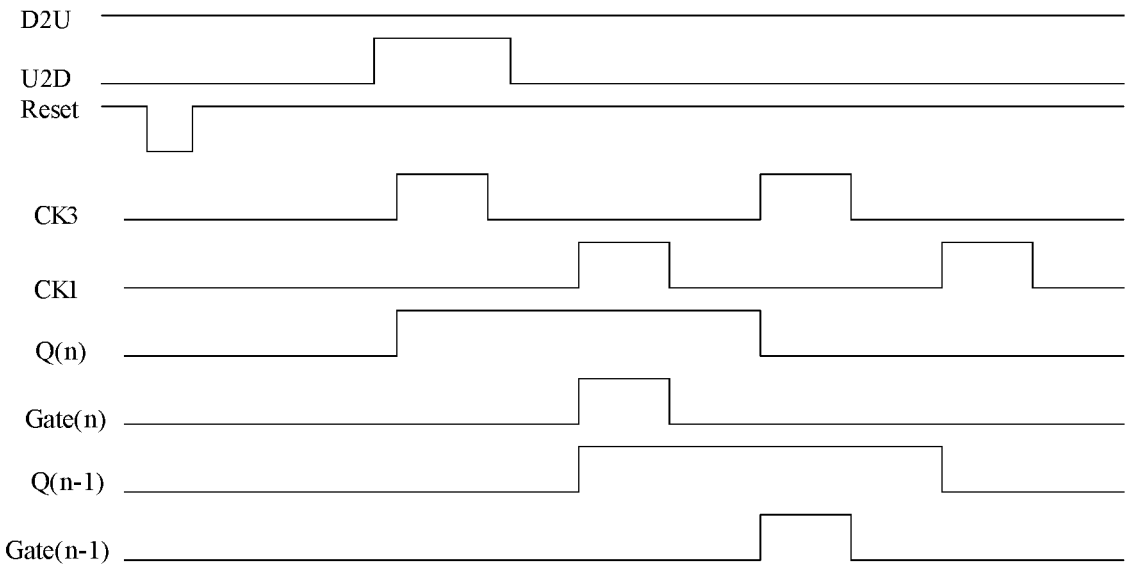
FIG. 3 is a timing diagram of the scanning driving circuit of the present disclosure performing reverse scanning.

Referring to FIG. 1 which is a schematic circuit of a first embodiment of a scanning driving circuit of the present disclosure, the scanning driving circuit includes a plurality of scanning driving units in cascade connection. The plurality of scanning driving units comprise a first stage scanning driving unit 1, a plurality of intermediate stage scanning driving units 2, and a last stage scanning driving unit 3. Each of the first stage scanning driving unit 1, each intermediate stage scanning driving unit 2 and the last stage scanning driving unit 3 includes:

A forward and reverse scanning circuit 100/102/103 for controlling the scanning driving circuit to perform a forward scanning or a reverse scanning, wherein the forward and reverse scanning circuit 100 of the first stage scanning driving unit 1 receives a forward scanning control voltage U2D, a reverse scanning control voltage D2U, and the output voltage of the turn-on voltage terminal VGH; the forward and reverse scanning circuit 102 of each of the intermediate stage scanning driving units 2 receives the forward scanning control voltage U2D and the reverse scanning control voltage D2U; and the forward and reverse scanning circuit 103 of the last stage scanning driving unit 3 receives the forward scanning control voltage U2D, the reverse scanning control voltage D2U, the output voltage of the turn-on voltage terminal VGH, and the output voltage of the turn-off voltage terminal VGL;

An input circuit 200 connected to the forward and reverse scanning circuits 100/102/103 for receiving the first clock signal CK1/CK3 and the second clock signal XCK1/XCK3 which is opposite to the first clock signal CK1/CK3 in phase and charging the pull-up control signal point Q;

A latch circuit 300 connected to the input circuit 200 for receiving the first clock signal CK1/CK3 and the second clock signal XCK1/XCK3 and latching signal of the pull-up control signal point Q;

An output circuit 400 connected to the latch circuit 300 for receiving the third clock signal CK3/CK1 and generating a scanning driving signal Gate in response to the signal of the third clock signal CK3/CK1 and the signal of the pull-up control signal point Q; and A reset circuit 500 connected to the latch circuit 300 for receiving reset signals Reset and resetting the pull-up control signal point Q.

Specifically, the forward and reverse scanning circuit 100 of the first stage scanning driving unit 1 includes first to fifth controllable switches T1 to T5. A control terminal of the first controllable switch T1 is connected to the reverse scanning control voltage D2U. A first terminal of the first controllable switch T1 is connected to the turn-on voltage terminal VGH. A second terminal of the first controllable switch T1 is connected to the first terminal of the second controllable switch T2. A control terminal of the controllable switch T2 is connected to a control terminal of the third controllable switch T3 and the forward scanning control voltage U2D. A second terminal of the second controllable switch T2 is connected to the second terminal of the third controllable switch T3, the input circuit 200, and a second terminal of the fifth controllable switch T5. A first terminal of the third controllable switch T3 is connected to a second terminal of the fourth controllable switch T4. A control terminal of the fourth controllable switch T4 is connected to a first terminal of the fourth controllable switch T4 and the reverse scanning control voltage D2U. A control terminal of the fifth controllable switch T5 is connected to the reverse scanning control voltage D2U. A first terminal of the fifth controllable switch T5 is connected to the pull-up control signal Q (n+1) of the next stage.

The forward and reverse scanning circuit 102 of each intermediate stage scanning driving unit 2 includes first and second transmission gates 11, 12. An input terminal of the first transmission gate 11 receives the pull-up control signal Q(n−1). A first control terminal of the first transmission gate 11 is connected to the forward scanning control voltage U2D. A second control terminal of the first transmission gate 11 is connected to the first control terminal of the second transmission gate 12 and the reverse scanning control voltage D2U. An output terminal of the first transmission gate 11 is connected to an output terminal of the second transmission gate 12 and the input circuit 200. An input terminal of the second transmission gate 12 receives the pull-up control signal Q (n+1). A second control terminal of the second transmission gate 12 is connected to the forward scanning control voltage U2D.

The forward and reverse scanning circuit 103 of the last stage scanning driving unit 3 includes sixth to tenth controllable switches T6 to T10. A control terminal of the sixth controllable switch T6 is connected to the reverse scanning control voltage D2U. A first terminal of the sixth controllable switch T6 is connected to the turn-on voltage terminal VGH. A second terminal of the sixth controllable switch T6 is connected to a first terminal of the seventh controllable switch T7. A control terminal of the seventh controllable switch T7 is connected to a control terminal of the eighth controllable switch T8 and the forward scanning control voltage U2D. A second terminal of the seventh controllable switch T7 is connected to a first terminal of the eighth controllable switch T8, the input circuit 200 and a second terminal of the tenth controllable switch T10. A second terminal of the eighth controllable switch T8 is connected to a second terminal of the ninth controllable switch T9. A control terminal of the ninth controllable switch T9 is connected to the reverse scanning control voltage D2U. A first terminal of the ninth controllable switch T9 is connected to the turn-off voltage terminal VGL. A control terminal of the tenth controllable switch T10 is connected to the reverse scanning control voltage D2U. A second terminal of the tenth controllable switch T10 is connected to the pull-up control signal Q (n−1) of the previous stage.

In the present embodiment, the first controllable switch T1, the second controllable switch T2, the fourth controllable switch T4, the eighth controllable switch T8, and the tenth controllable switch T10 are P-type thin film transistors. The control terminals, the first terminals, and the second terminals of the first controllable switch T1, the second controllable switch T2, the fourth controllable switch T4, the eighth controllable switch T8, and the tenth controllable switch T10 correspond to the gates, the drains, and the sources of the P-type thin film transistors, respectively. The third controllable terminal T3, the fifth controllable switch T5, the sixth controllable switch T6, the seventh controllable switch T7, and the ninth controllable switch T9 are N-type thin film transistors. The control terminals, the first terminals, and the second terminals of the third controllable switch T3, the fifth controllable switch T5, the sixth controllable switch T6, the seventh controllable switch T7, and the ninth controllable switch T9 respectively correspond to the gates, the drains, and the sources of the N-type thin film transistors. In other embodiments, the first to the tenth controllable switches T1-T10 may be other types of switches as long as the object of the present disclosure can be achieved.

Specifically, the input circuit 200 includes a first clock control inverter Y1. An input terminal of the first clock control inverter Y1 is connected to the second terminal of the third controllable switch T3 or the output terminal of the first transmission gate 11 or the first terminal of the eighth controllable switch T8. A first control terminal of the first clock control inverter Y1 is connected to the second clock signal XCK1/XCK3. A second control terminal of the first clock control inverter Y1 is connected to the first clock signal CK1/CK3. An the output terminal of the first clock control inverter Y1 is connected to the latch circuit 300.

Specifically, the latch circuit 300 includes a first inverter U1 and a second clock control inverter Y2. An input terminal of the first inverter U1 is connected to the output terminal of the first clock control inverter Y1, the reset circuit 500 and an input terminal of the second clock control inverter Y2. An output terminal of the first inverter U1 is connected to an output terminal of the second clock control inverter Y2, the pull-up control signal Q (n) of the same stage, and the output circuit 400. A first control terminal of the second clock control inverter Y2 is connected to the first clock signal CK1/CK3. A the second control terminal of the second clock control inverter Y2 is connected to the second clock signal XCK1/XCK3.

Specifically, the output circuit 400 includes the second to fourth inverters U2-U4 and NAND gate X1. A first input terminal of the NAND gate X1 is connected to the output terminal of the first inverter U1. A second input terminal of the NAND gate X1 is connected to the third clock signal CK1/CK3. An output terminal of the NAND gate X1 is connected to an input terminal of the second inverter U2. An output terminal of the second inverter U2 is connected to an input terminal of the third inverter U3. An output terminal of the third inverter U3 is connected to an input terminal of the fourth inverter U4. An output terminal of the fourth inverter U4 outputs the scanning driving signal Gate.

Specifically, the reset circuit 500 includes an eleventh controllable switch T11. A control terminal of the eleventh controllable switch T11 is connected to the reset signal Reset. A first terminal of the eleventh controllable switch T11 is connected to the input terminal of the first inverter U1. A second terminal of the eleventh controllable switch T11 is connected to the turn-on voltage terminal VGH.

In the present embodiment, the eleventh controllable switch T11 is a P-type thin film transistor. The control terminal, the first terminal and the second terminal of the eleventh controllable switch T11 respectively corresponding to the gate, the drain and the source of the P-type thin film transistor. In other embodiments, the eleventh controllable switch T11 may also be other types of switches, as long as the object of the present disclosure can be achieved.

Referring to FIG. 1, FIG. 2, FIG. 4, and FIG. 5, the forward scanning operation of the scanning driving circuit is described as below, taking the first stage scanning driving unit as an example:

Before the low level signal of the forward scanning control voltage U2D is coming, all of the scanning driving units are reset, the pull-up control signal points Q of all scanning driving units are reset to the low level signal, and all scanning driving signals are at low level signal. The pull-up control signal point Q of the first stage scanning driving unit 1 is charged to a high level signal when the low level signal of the forward scanning control voltage U2D and the high level signal of the first clock signal CK1 come at the same time. When the first clock signal CK1 becomes the low level signal, the latch circuit 30 latches the high level signal of the pull-up control signal point Q (1). When the high level signal of the clock signal CK3 is present, the scanning driving signal Gate (1) is a high level signal, that is, the scanning driving signal Gate1 of the first stage is generated. When the high level signal of the first clock signal CK1 arrives again, the pull-up control signal point Q (1) is charged to a low level signal, and then the pull-up control signal point Q (1) is always latched and inputted with a low level signal. The scanning driving signal Gate (1) maintains a stable low level signal.

Referring to FIG. 1, FIG. 3, FIG. 4, and FIG. 5, the reverse scanning operation principle of the scanning driving circuit is described as below, taking the last stage scanning driving unit as an example:

Before the high level signal of the forward scanning control voltage U2D comes, all scanning driving units are reset, the pull-up control signal point Q of all scanning driving units are reset to low level signal, and the scanning driving signal Gate is at low level signal. The pull-up control signal point Q of the last stage scanning driving unit is charged to a high level signal when the low level signal of the forward scanning control voltage U2D and the high level signal of the first clock signal CK3 come simultaneously. The latch circuit 30 latches the high level signal of the pull-up control signal point Q (n) when the first clock signal CK3 changes to the low level signal. When the high level signal of the third clock signal CK1 is present, the scanning driving signal Gate(n) is a high level signal, that is, the scanning driving signal Gate (n) of the last stage is generated. When the high level signal of the first clock signal CK3 arrives again, the pull-up control signal point Q (n) is charged to a low level signal, and then the pull-up control signal point Q (n) is latched and inputted with low level signal. The scanning driving signal Gate (n) maintains a stable low level signal.

Figure 4:
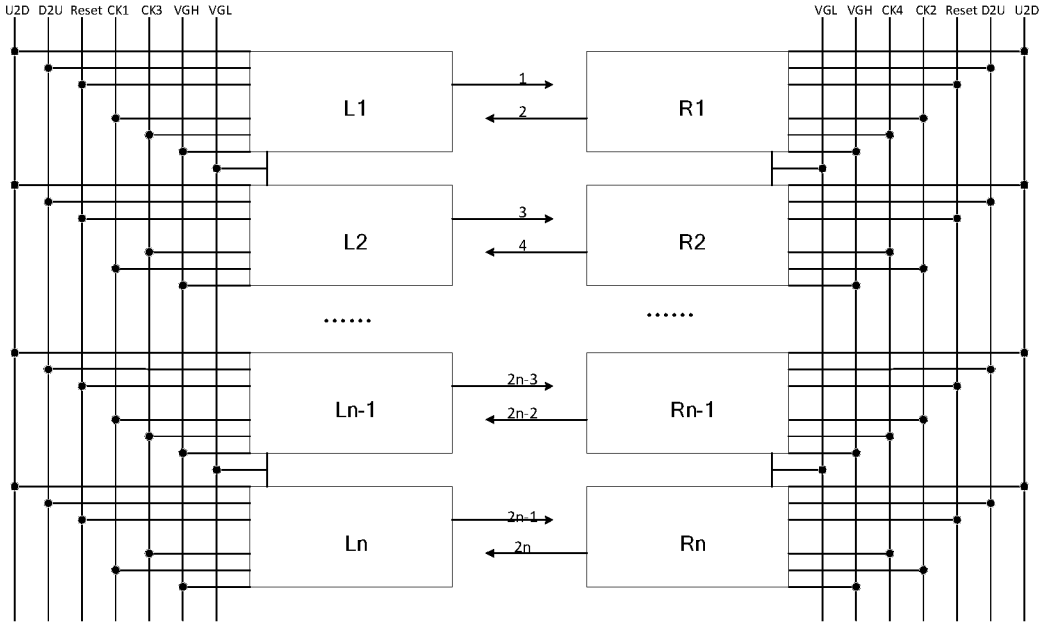
FIG. 4 is a schematic view of an architecture of the scanning driving circuit of the present disclosure.
Figure 5:
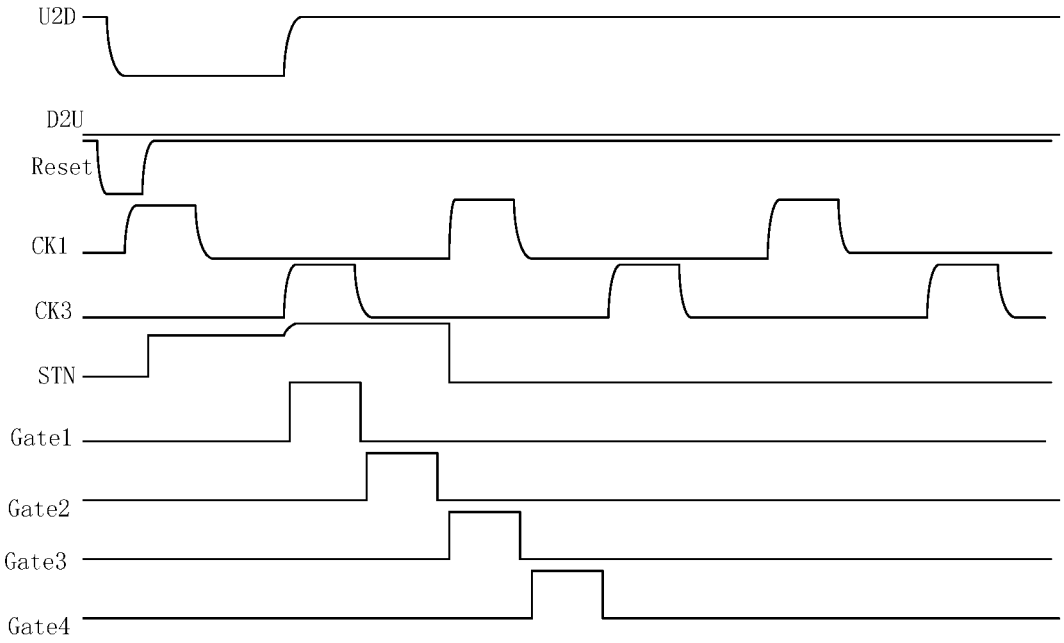
FIG. 5 is a schematic view of an emulation waveform of the scanning driving circuit of the present disclosure.

Referring to FIGS. 4 and 5, it can be seen that the unilateral driving of the scanning driving circuit needs two clock signal CK traces, one forward scanning control voltage U2D trace, one inverse scanning control voltage D2U trace, one reset signal Reset trace, a turn-on voltage VGH trace, and a turn-off voltage VGL trace. Compared with the unilateral driving of the existing scanning driving circuit, a trigger signal STV trace is saved, which facilitates to design narrow frame circuits. The scanning driving circuit works well.

Figure 6:
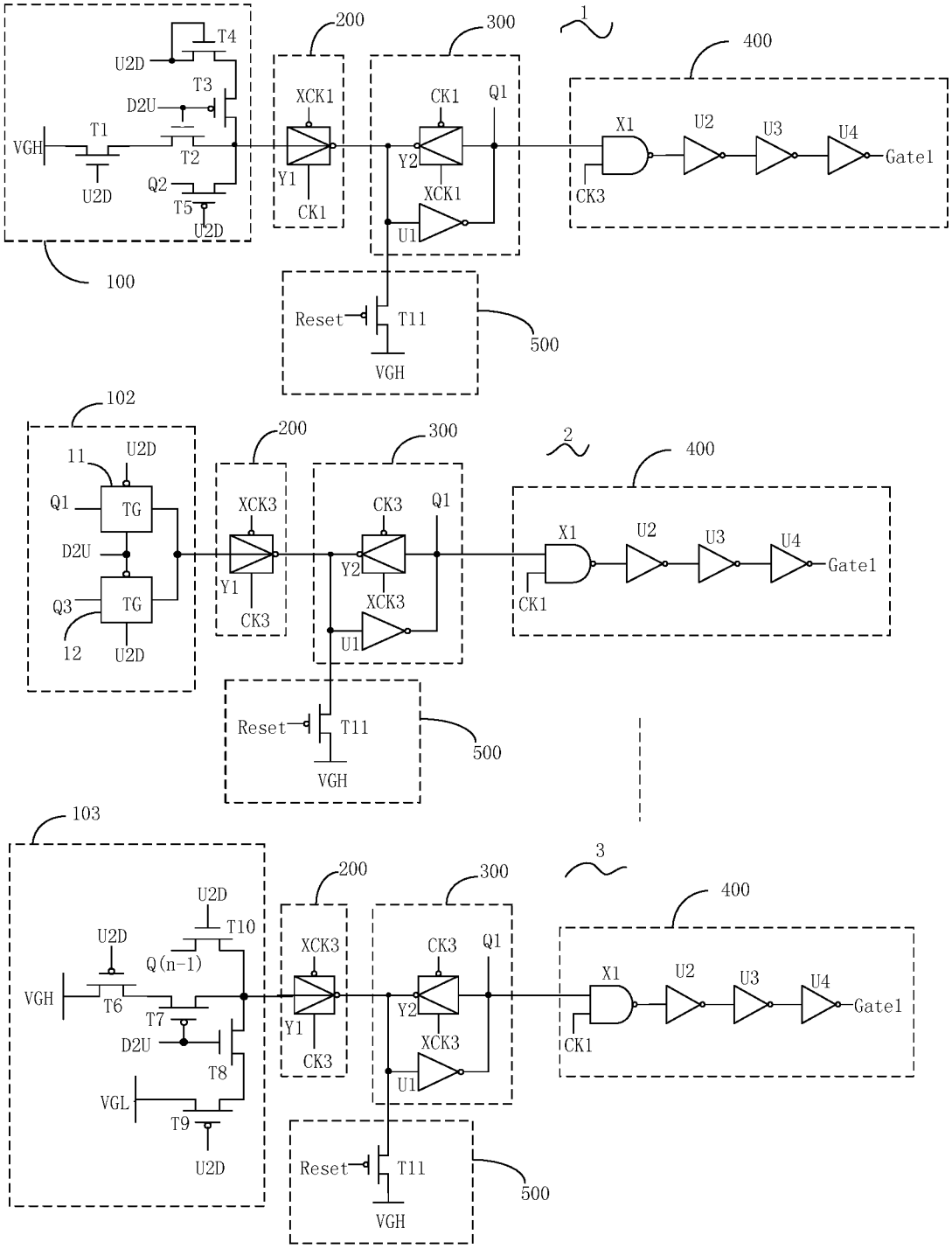
FIG. 6 is a schematic circuit of a second embodiment of the scanning driving circuit of the present disclosure.

Referring to FIG. 6 which is a diagram circuit of a second embodiment of the scanning driving circuit of the present disclosure. The second embodiment of the scanning driving circuit differs from the above described first embodiment in that: the forward and reverse scanning circuit 100 of the first stage scanning driving unit 1 includes first to fifth controllable switches T1 to T5, a control terminal of the first controllable switch T1 is connected to the forward scanning control voltage U2D. A first terminal of the first controllable switch T1 is connected to the turn-on voltage terminal VGH. A second terminal of the first controllable switch T1 is connected to a first terminal of the second controllable switch T2. A control terminal of the second controllable switch T2 is connected to a control terminal of the third controllable switch T3 and the reverse scanning control voltage D2U. A second terminal of the second controllable switch T2 is connected to a second terminal of the third controllable switch T3, the input circuit 200, and a second terminal of the fifth controllable switch T5. A first terminal of the third controllable switch T3 is connected to a second terminal of the fourth controllable switch T4. A control terminal of the fourth controllable switch T4 is connected to a first terminal of the fourth controllable switch T4 and the forward scanning control voltage U2D. A control terminal of the fifth controllable switch T5 is connected to the forward scanning control voltage U2D. A first terminal of the fifth controllable switch T5 is connected to the pull-up control signal Q (n+1) of the next stage;

The forward and reverse scanning circuit 102 of each intermediate stage scanning driving unit 2 includes first and second transmission gates 11, 12. An input terminal of the first transmission gates 11 is connected to the pull-up control signals Q (n−1) of the previous stage. A first control terminal of the first transmission gate 11 is connected to the forward scanning control voltage U2D. A second control terminal of the first transmission gate 11 is connected to the first control terminal of the second transmission gate 12 and the reverse scanning control voltage D2U. An output terminal of the first transmission gate 11 is connected to an output terminal of the second transmission gate 12 and the input circuit 200. An input terminal of the second transmission gate 12 is connected to the pull-up control signal point Q (n+1) of the next stage. A second control terminal of the second transmission gate 12 is connected to the forward scanning control voltage U2D.

The forward and reverse scanning circuit 103 of the last stage scanning driving unit 3 includes sixth to tenth controllable switches T6 to T10. A control terminal of the sixth controllable switch T6 is connected to the forward scanning control voltage U2D. A first terminal of the sixth controllable switch T6 is connected to the turn-on voltage terminal VGH. A second terminal of the sixth controllable switch T6 is connected to a first terminal of the seventh controllable switch T7. A control terminal of the seventh controllable switch T7 is connected to a control terminal of the eighth controllable switch T8 and the reverse scanning control voltage D2U. A second terminal of the seventh controllable switch T7 is connected to a first terminal of the eighth controllable switch T8, the input circuit 200, and a second terminal of the tenth controllable switch T10. A second terminal of the eighth controllable switch T8 is connected to a second terminal of the ninth controllable switch T9. A control terminal of the ninth controllable switch T9 is connected to the forward scanning control voltage U2D. A first terminal of the ninth controllable switch T9 is connected to the turn-off voltage terminal VGL. A control terminal of the tenth controllable switch T10 is connected to the forward scanning control voltage U2D. A second terminal of the tenth controllable switch T10 is connected to the pull-up control signal point Q (n−1) of the previous stage.

In the present embodiment, the first controllable switch T1, the second controllable switch T2, the fourth controllable switch T4, the eighth controllable switch T8, and the tenth controllable switch T10 are all N-type thin film transistors. The control terminals, the first terminals, and the second terminals of the first controllable switch T1, the second controllable switch T2, the fourth controllable switch T4, the eighth controllable switch T8 and the tenth controllable switch T10 respectively corresponding to the gates, drains, and sources of the N-type thin film transistors. The third controllable switch T3, the fifth controllable switch T5, the sixth controllable switch T6, the seventh controllable switch T7, and the ninth controllable switch T9 are all P-type thin film transistors. The control terminal, the first terminal, and the second terminal of the third controllable switch T3, the fifth controllable switch T5, the sixth controllable switch T6, the seventh controllable switch T7 and the ninth controllable switch T9 respectively corresponding to the gates, the drains, and the sources of the P-type thin film transistors. In other embodiments, the first to tenth controllable switches T1-T10 may be other types of switches as long as the object of the present invention can be achieved.

The operation principle of the second embodiment of the scanning driving circuit is the same as that of the above-described first embodiment, and is not described again.

Figure 7:
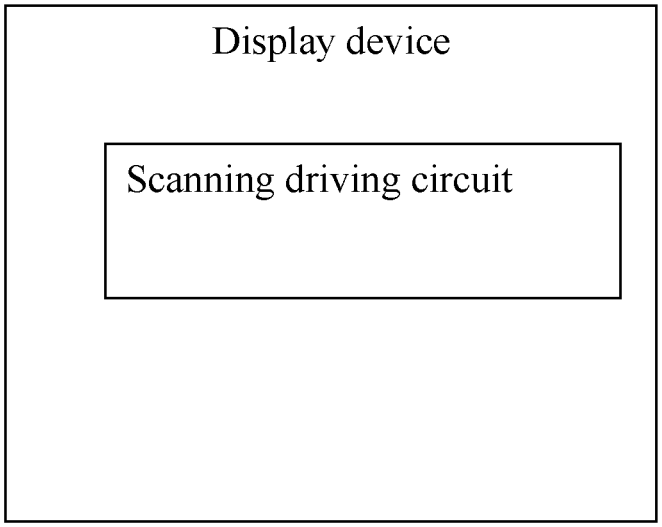
FIG. 7 is a schematic structural view of a display device of the present disclosure.

Referring to FIG. 7 which illustrates a display device of the present disclosure. The display device includes any of the scanning driving circuits described above, and the other elements and functions of the display device are the same as those of conventional display devices and are not described here.

The scanning driving circuit and the display device are designed to differentiate the forward and reverse scanning circuits of the first stage scanning driving unit and the last stage scanning driving unit from the forward and reverse scanning driving circuits of the other intermediate stage scanning driving units. Wherein the forward and reverse scanning circuit of the first stage scanning driving unit receives the forward scanning control voltage, the reverse scanning control voltage, and the output voltage of the turn-on voltage terminal; the forward and reverse scanning circuit of each of the intermediate stage scanning driving units receives the forward scanning control voltage and the reverse scanning control voltage; and the forward and reverse scanning circuit of the last stage scanning driving unit receives the forward scanning control voltage, the reverse scanning control voltage, the output voltage of the turn-on voltage terminal, and the output voltage of the turn-off voltage terminal. Thus, when the scanning driving circuit performs forward scanning or reverse scanning there is no needs to receive trigger signals, which reduces the number of signal lines, simplifies the signal line design, saves the space, and facilitates to the narrow frame design.

The foregoing is merely embodiments of the present disclosure, and is not intended to limit the scope of the disclosure. Any transformation of equivalent structure or equivalent process which uses the specification and the accompanying drawings of the present disclosure, or directly or indirectly application in other related technical fields, are likewise included within the scope of the protection of the present disclosure.

What is claimed is:

1. A scanning driving circuit, comprises a plurality of stages of scanning driving units in cascade connection, the plurality of stages of scanning driving units comprising:

a first stage scanning driving unit;

a plurality of intermediate stage scanning driving units;

a last stage scanning driving unit;

wherein, the first stage scanning driving unit, each intermediate stage scanning driving units, and the last stage scanning driving unit each comprising:

a forward and reverse scanning circuit, configured to control the scanning driving circuit to forward scanning or reverse scanning, wherein the forward and reverse scanning circuit of the first stage scanning driving unit receives a forward scanning control voltage, a reverse scanning control voltage, and an output voltage of a turn-on voltage terminal, wherein the forward and reverse scanning circuit of each of the intermediate stage scanning driving units receives the forward scanning control voltage and the reverse scanning control voltage, wherein the forward and reverse scanning circuit of the last stage scanning driving unit receives the forward scanning control voltage, the reverse scanning control voltage, the output voltage of the turn-on voltage terminal, and the output voltage of a turn-off voltage terminal;

an input circuit, connected to the forward and reverse scanning circuit and configured to receive a first clock signal and a second clock signal opposite to the first clock signal in phase and to charge a pull-up control signal point;

a latch circuit, connected to the input circuit and configured to receive the first clock signal and the second clock signal and to latch a signal of the pull-up control signal point;

an output circuit, connected to the latch circuit and configured to receive a third clock signal and generate a scanning driving signal in response to the third clock signal and the signal of the pull-up control signal point; and a reset circuit, connected to the latch circuit and configured to receive a reset signal and reset the pull-up control signal points;

wherein the forward and reverse scanning circuit of the first stage scanning driving unit comprises a first, a second, a third, a fourth, and a fifth controllable switch, a control terminal of the first controllable switch is connected to the forward scanning control voltage, a first terminal of the first controllable switch is connected to the turn-on voltage terminal, a second terminal of the first controllable switch is connected to a first terminal of the second controllable switch, a control terminal of the second controllable switch is connected to a control terminal of the third controllable switch and the reverse scanning control voltage, and a second terminal of the second controllable switch is connected to a second terminal of the third controllable switch, the input circuit, and a second terminal of the fifth controllable switch, a first terminal of the third controllable switch is connected to a second terminal of the fourth controllable switch, a control terminal of the fourth controllable switch is connected to a first terminal of the fourth controllable switch and the forward scanning control voltage, a control terminal of the fifth controllable switch is connected to the forward scanning control voltage, a first terminal of the fifth controllable switch is connected to a pull-up control signal point of a next stage;

the forward and reverse scanning circuit of each intermediate stage scanning driving unit comprises a first and a second transmission gate, an input terminal of the first transmission gates is connected to a pull-up control signal point of a previous stage, a first control terminal of the first transmission gate is connected to the forward scanning control voltage, a second control terminal of the first transmission gate is connected to a first control terminal of the second transmission gate and the reverse scanning control voltage, an output terminal of the first transmission gate is connected to an output terminal of the second transmission gate and the input circuit, an input terminal of the second transmission gate is connected to the pull-up control signal point of the next stage, a second control terminal of the second transmission gate is connected to the forward scanning control voltage; and the forward and reverse scanning circuit of the last stage scanning driving unit comprises a sixth, a seventh, an eighth, a ninth and a tenth controllable switch, a control terminal of the sixth controllable switch is connected to the forward scanning control voltage, a first terminal of the sixth controllable switch is connected to the turn-on voltage terminal, a second terminal of the sixth controllable switch is connected to a first terminal of the seventh controllable switch, a control terminal of the seventh controllable switch is connected to a control terminal of the eighth controllable switch and the reverse scanning control voltage, a second terminal of the seventh controllable switch is connected to a first terminal of the eighth controllable switch, the input circuit, and a second terminal of the tenth controllable switch, a second terminal of the eighth controllable switch is connected to a second terminal of the ninth controllable switch, a control terminal of the ninth controllable switch is connected to the forward scanning control voltage, a first terminal of the ninth controllable switch is connected to a turn-off voltage terminal, a control terminal of the tenth controllable switch is connected to the forward scanning control voltage, a second terminal of the tenth controllable switch is connected to the pull-up control signal point of the previous stage.

2. The scanning driving circuit of claim 1, wherein the first controllable switch, the second controllable switch, the fourth controllable switch, the eighth controllable switch, and the tenth controllable switch are N-type thin film transistors, the control terminals, the first terminals, and the second terminals of the first controllable switch, the second controllable switch, the fourth controllable switch, the eighth controllable switch, and the tenth controllable switch respectively correspond to gates, drains, and sources of the N-type thin film transistors; the third controllable switch, the fifth controllable switch, the sixth controllable switch, the seventh controllable switch, and the ninth controllable switch are P-type thin film transistors, the control terminals, the first terminals, and the second terminals of the third controllable switch, the fifth controllable switch, the sixth controllable switch, the seventh controllable switch, and the ninth controllable switch respectively correspond to gates, drains, and sources of the P-type thin film transistors.

3. The scanning driving circuit of claim 1, wherein the input circuit comprises a first clock control inverter, an input terminal of the first clock control inverter is connected to the second terminal of the third controllable switch or the output terminal of the first transmission gate or the first terminal of the eighth controllable switch, a first control terminal of the first clock control inverter is connected to the second clock signal, a second control terminal of the first clock control inverter is connected to the first clock signal, and an output terminal of the first clock control inverter is connected to the latch circuit.

4. The scanning driving circuit of claim 3, wherein the latch circuit comprises a first inverter and a second clock control inverter, an input terminal of the first inverter is connected to an output terminal of the first clock control inverter, the reset circuit, and an input terminal of the second clock control inverter, an output terminal of the first inverter is connected to an output terminal of the second clock control inverter, a pull-up control signal point of a same stage, and the output circuit, a first control terminal of the second clock control inverter is connected to the first clock signal, a second control terminal of the second clock control inverter is connected to the second clock signal.

5. The scanning driving circuit of claim 4, wherein the output circuit comprises a second, a third, a fourth inverter and an NAND gate, a first input terminal of the NAND gate is connected to the output terminal of the first inverter, a second input terminal of the NAND gate is connected to the third clock signal, an output terminal of the NAND gate is connected to an input terminal of the second inverter, an output terminal of the second inverter is connected to an input terminal of the third inverter, an output terminal of the third inverter is connected to an input terminal of the fourth inverter, and an output terminal of the fourth inverter outputs the scanning driving signal.

6. The scanning driving circuit of claim 4, wherein the reset circuit comprises an eleventh controllable switch, a control terminal of the eleventh controllable switch is connected to the reset signal, a first terminal of the eleventh controllable switch is connected to the input terminal of the first inverter, and a second terminal of the eleventh controllable switch is connected to the turn-on voltage terminal.

7. A display device, comprises a scanning driving circuit which comprises a plurality of stages of scanning driving units in cascade connection, the plurality of stages of scanning driving units comprise:

a first stage scanning driving unit;

a plurality of intermediate stage scanning driving units;

a last stage scanning driving unit;

wherein, the first stage scanning driving unit, each intermediate stage scanning driving unit, and the last stage last scanning driving unit each comprising:

a forward and reverse scanning circuit, configured to control the scanning driving circuit to forward scanning or reverse scanning, wherein the forward and reverse scanning circuit of the first stage scanning driving unit receives a forward scanning control voltage, a reverse scanning control voltage, and an output voltage of a turn-on voltage terminal, wherein the forward and reverse scanning circuit of each of the intermediate stage scanning driving units receives the forward scanning control voltage and the reverse scanning control voltage, wherein the forward and reverse scanning circuit of the last stage scanning driving unit receives the forward scanning control voltage, the reverse scanning control voltage, the output voltage of the turn-on voltage terminal, and the output voltage of a turn-off voltage terminal;

an input circuit, connected to the forward and reverse scanning circuit and configured to receive a first clock signal and a second clock signal opposite to the first clock signal in phase and to charge a pull-up control signal point;

a latch circuit, connected to the input circuit and configured to receive the first clock signal and the second clock signal and to latch a signal of the pull-up control signal point;

an output circuit, connected to the latch circuit and configured to receive a third clock signal and generate a scanning driving signal in response to the third clock signal and the signal of the pull-up control signal point; and a reset circuit, connected to the latch circuit and configured to receive reset signals and reset the pull-up control signal points;

wherein the forward and reverse scanning circuit of the first stage scanning driving unit comprises a first, a second, a third, a fourth, and a fifth controllable switch, a control terminal of the first controllable switch is connected to the forward scanning control voltage, a first terminal of the first controllable switch is connected to the turn-on voltage terminal, a second terminal of the first controllable switch is connected to a first terminal of the second controllable switch, a control terminal of the second controllable switch is connected to a control terminal of the third controllable switch and the reverse scanning control voltage, a second terminal of the second controllable switch is connected to a second terminal of the third controllable switch, the input circuit, and a second terminal of the fifth controllable switch, a first terminal of the third controllable switch is connected to a second terminal of the fourth controllable switch, a control terminal of the fourth controllable switch is connected to a first terminal of the fourth controllable switch and the forward scanning control voltage, a control terminal of the fifth controllable switch is connected to the forward scanning control voltage, a first terminal of the fifth controllable switch is connected to a pull-up control signal point of a next stage;

the forward and reverse scanning circuit of each intermediate stage scanning driving unit comprises a first and a second transmission gate, an input terminal of the first transmission gates is connected to a pull-up control signal point of a previous stage, a first control terminal of the first transmission gate is connected to the forward scanning control voltage, a second control terminal of the first transmission gate is connected to a first control terminal of the second transmission gate and the reverse scanning control voltage, an output terminal of the first transmission gate is connected to an output terminal of the second transmission gate and the input circuit, an input terminal of the second transmission gate is connected to the pull-up control signal point of the next stage, a second control terminal of the second transmission gate is connected to the forward scanning control voltage; and the forward and reverse scanning circuit of the last stage scanning driving unit comprises a sixth, a seventh, an eighth, a ninth and a tenth controllable switch, a control terminal of the sixth controllable switch is connected to the forward scanning control voltage, a first terminal of the sixth controllable switch is connected to the turn-on voltage terminal, a second terminal of the sixth controllable switch is connected to a first terminal of the seventh controllable switch, a control terminal of the seventh controllable switch is connected to a control terminal of the eighth controllable switch and the reverse scanning control voltage, a second terminal of the seventh controllable switch is connected to a first terminal of the eighth controllable switch, the input circuit, and a second terminal of the tenth controllable switch, a second terminal of the eighth controllable switch is connected to a second terminal of the ninth controllable switch, a control terminal of the ninth controllable switch is connected to the forward scanning control voltage, a first terminal of the ninth controllable switch is connected to a turn-off voltage terminal, a control terminal of the tenth controllable switch is connected to the forward scanning control voltage, a second terminal of the tenth controllable switch is connected to the pull-up control signal point of the previous stage.

8. The display device of claim 7, wherein the first controllable switch, the second controllable switch, the fourth controllable switch, the eighth controllable switch, and the tenth controllable switch are N-type thin film transistors, the control terminals, the first terminals, and the second terminals of the first controllable switch, the second controllable switch, the fourth controllable switch, the eighth controllable switch, and the tenth controllable switch respectively correspond to gates, drains, and sources of the N-type thin film transistors; the third controllable switch, the fifth controllable switch, the sixth controllable switch, the seventh controllable switch, and the ninth controllable switch are P-type thin film transistors, the control terminal, the first terminal, and the second terminal of the third controllable switch, the fifth controllable switch, the sixth controllable switch, the seventh controllable switch, and the ninth controllable switch respectively correspond to gates, drains, and sources of the P-type thin film transistors.

9. The display device of claim 7, wherein the input circuit comprises a first clock control inverter, an input terminal of the first clock control inverter is connected to the second terminal of the third controllable switch or the output terminal of the first transmission gate or the first terminal of the eighth controllable switch, a first control terminal of the first clock control inverter is connected to the second clock signal, a second control terminal of the first clock control inverter is connected to the first clock signal, and an output terminal of the first clock control inverter is connected to the latch circuit.

10. The display device of claim 9, wherein the latch circuit comprises a first inverter and a second clock control inverter, an input terminal of the first inverter is connected to an output terminal of the first clock control inverter, the reset circuit, and an input terminal of the second clock control inverter, an output terminal of the first inverter is connected to an output terminal of the second clock control inverter, a pull-up control signal point of a same stage, and the output circuit, a first control terminal of the second clock control inverter is connected to the first clock signal, a second control terminal of the second clock control inverter is connected to the second clock signal.

11. The display device of claim 10, wherein the output circuit comprises a second, a third, a fourth inverter and an NAND gate, a first input terminal of the NAND gate is connected to the output terminal of the first inverter, a second input terminal of the NAND gate is connected to the third clock signal, an output terminal of the NAND gate is connected to an input terminal of the second inverter, an output terminal of the second inverter is connected to an input terminal of the third inverter, an output terminal of the third inverter is connected to an input terminal of the fourth inverter, an output terminal of the fourth inverter outputs the scanning driving signal.

12. The display device of claim 10, wherein the reset circuit comprises an eleventh controllable switch, a control terminal of the eleventh controllable switch is connected to the reset signal, a first terminal of the eleventh controllable switch is connected to the input terminal of the first inverter, a second terminal of the eleventh controllable switch is connected to the turn-on voltage terminal.

13. A scanning driving circuit, comprises a plurality of stages of scanning driving units in cascade connection, the plurality of stages of scanning driving units comprising:

a first stage scanning driving unit;

a plurality of intermediate stage scanning driving units;

a last stage scanning driving unit;

wherein, the first stage scanning driving unit, each intermediate stage scanning driving units, and the last stage scanning driving unit each comprising:

a forward and reverse scanning circuit, configured to control the scanning driving circuit to forward scanning or reverse scanning, wherein the forward and reverse scanning circuit of the first stage scanning driving unit receives a forward scanning control voltage, a reverse scanning control voltage, and an output voltage of a turn-on voltage terminal, wherein the forward and reverse scanning circuit of each of the intermediate stage scanning driving units receives the forward scanning control voltage and the reverse scanning control voltage, wherein the forward and reverse scanning circuit of the last stage scanning driving unit receives the forward scanning control voltage, the reverse scanning control voltage, the output voltage of the turn-on voltage terminal, and the output voltage of a turn-off voltage terminal;

an input circuit, connected to the forward and reverse scanning circuit and configured to receive a first clock signal and a second clock signal opposite to the first clock signal in phase and to charge a pull-up control signal point;

a latch circuit, connected to the input circuit and configured to receive the first clock signal and the second clock signal and to latch a signal of the pull-up control signal point; an output circuit, connected to the latch circuit and configured to receive a third clock signal and generate a scanning driving signal in response to the third clock signal and the signal of the pull-up control signal point; and a reset circuit, connected to the latch circuit and configured to receive a reset signal and reset the pull-up control signal points;

wherein the forward and reverse scanning circuit of the first stage scanning driving unit comprises a first, a second, a third, a fourth and a fifth controllable switch, a control terminal of the first controllable switch is connected to the reverse scanning control voltage, a first terminal of the first controllable switch is connected to the turn-on voltage terminal, a second terminal of the first controllable switch is connected to a first terminal of the second controllable switch, a control terminal of the second controllable switch is connected to a control terminal of the third controllable switch and the forward scanning control voltage, a second terminal of the second controllable switch is connected to a second terminal of the third controllable switch, the input circuit, and a second terminal of the fifth controllable switch, a first terminal of the third controllable switch is connected to a second terminal of the fourth controllable switch, a control terminal of the fourth controllable switch is connected to a first terminal of the fourth controllable switch and the reverse scanning control voltage, a control terminal of the fifth controllable switch is connected to the reverse scanning control voltage, a first terminal of the fifth controllable switch is connected to a pull-up control signal point of a next stage;

the forward and reverse scanning circuit of each intermediate stage scanning driving unit comprises a first and a second transmission gate, an input terminal of the first transmission gate is connected to a pull-up control signal point of a previous stage, a first control terminal of the first transmission gate is connected to the forward scanning control voltage, a second control terminal of the first transmission gate is connected to a first control terminal of the second transmission gate and the reverse scanning control voltage, an output terminal of the first transmission gate is connected to an output terminal of the second transmission gate and the input circuit, an input terminal of the second transmission gate in connected to the pull-up control signal point of the next stage, a second control terminal of the second transmission gate is connected to the forward scanning control voltage;

the forward and reverse scanning circuit of the last stage scanning driving unit comprises a sixth, a seventh, an eighth, a ninth and a tenth controllable switch, a control terminal of the sixth controllable switch is connected to the reverse scanning control voltage, a first terminal of the six controllable switch is connected to the turn-on voltage terminal, a second terminal of the sixth controllable switch is connected to a first terminal of the seventh controllable switch, a control terminal of the seventh controllable switch is connected to a control terminal of the eighth controllable switch and the forward scanning control voltage, a second terminal of the seventh controllable switch is connected to a first terminal of the eighth controllable switch, the input circuit, and a second terminal of the tenth controllable switch, a second terminal of the eighth controllable switch is connected to a second terminal of the ninth controllable switch, a control terminal of the ninth controllable switch is connected to the reverse scanning control voltage, a first terminal of the ninth controllable switch is connected to the turn-off voltage terminal, a control terminal of the tenth controllable switch is connected to the reverse scanning control voltage, a second terminal of the tenth controllable switch is connected to the pull-up control signal point of the previous stage.

14. The scanning driving circuit of claim 13, wherein the first controllable switch, the second controllable switch, the fourth controllable switch, the eighth controllable switch, and the tenth controllable switch are P-type thin film transistors, the control terminals, the first terminals, and the second terminals of the first controllable switch, the second controllable switch, the fourth controllable switch, the eighth controllable switch, and the tenth controllable switch correspond to gates, drains and sources of the P-type thin film transistors, respectively; the third controllable switch, the fifth controllable switch, the sixth controllable switch, the seventh controllable switch, and the ninth controllable switch are N-type thin film transistors, the control terminals, the first terminals, and the second terminals of the third controllable switch, the fifth controllable switch, the sixth controllable switch, the seventh controllable switch, and the ninth controllable switch respectively correspond to gates, drains and sources of the N-type thin film transistors.

15. The scanning driving circuit of claim 13, wherein the input circuit comprises a first clock control inverter, an input terminal of the first clock control inverter is connected to the second terminal of the third controllable switch or the output terminal of the first transmission gate or the first terminal of the eighth controllable switch, a first control terminal of the first clock control inverter is connected to the second clock signal, a second control terminal of the first clock control inverter is connected to the first clock signal, and an output terminal of the first clock control inverter is connected to the latch circuit.

* * * * *